United States Patent [19]

Herrin

[11] 4,347,930

[45] Sep. 7, 1982

[54] HANGING PACKAGE

[75] Inventor: Lenny Herrin, Elkins Park, Pa.

[73] Assignee: Regent Paper Box Company, Philadelphia, Pa.

[21] Appl. No.: 196,375

[22] Filed: Oct. 14, 1980

[51] Int. Cl.[3] ..... B65D 25/22; B65D 5/44; B65D 25/54

[52] U.S. Cl. ..... 206/45.34; 206/806; 229/52 A

[58] Field of Search ..... 206/44 R, 45.34, 279, 206/284, 806; 229/52 A, 52 B

[56] References Cited

U.S. PATENT DOCUMENTS

| | | | |
|---|---|---|---|
| 2,128,509 | 8/1938 | Swope | 229/52 A |
| 3,146,937 | 9/1964 | Vesak | 229/52 A |
| 3,380,575 | 4/1968 | Hennessey | 206/45.34 |

*Primary Examiner*—William T. Dixson, Jr.

*Attorney, Agent, or Firm*—Lerner, David, Littenberg & Samuel

[57] ABSTRACT

A package adapted to be supported by a hook comprises a container which cooperates with a hanger capable of being readily assembled with the container. The container has an aperture adjacent the intersection of its top wall and rear wall, and the hanger has a head which projects upwardly through the aperture to provide an opening adapted to engage the hook. The hanger also has a pair of arms which extend outwardly from the head to engage along the underside of the top wall. A notch is provided in the hanger at the intersection of the head and the right hand arm for engaging a portion of the top wall after the head has been slid laterally upon release of the left hand arm from its forwardly flexed position during passage of the head upwardly through the aperture. The end of the left hand arm engages the left side wall to latch the hanger in position.

7 Claims, 3 Drawing Figures

HANGING PACKAGE

FIELD OF THE INVENTION

The present invention relates to product display packages, and more particularly, the present invention relates to packages adapted to be hung by hooks from display racks.

BACKGROUND OF THE INVENTION

Modern merchandising of packaged products often involves the hanging of such products in tandem from a rod extending outwardly from an upright support. Generally, a tab having an aperture is provided on the package, or the package is provided with a hole, to enable the package to be suspended from the rod. While the tab is generally formed integral with one of the walls of the package, such a structure requires that the package be designed specifically for hanging, and this normally requires special machinery and/or operations. In addition, because such packages are usually fabricated cardboard, there is a tendency for the tabs to tear, thereby preventing the package from being hung.

Packages which display products contained therein are known. Such a package normally includes a container of cardboard or other inexpensive material with a front cover of clear plastic. Such packaging is often used to merchandise soft goods, such as men's and women's undergarments; however, because of the size and weight of such packages, they are often merchandised simply by stacking them on one another on a shelf. There is a demand for a suitable hanger to enable such packaging to be hung from a rod or hook.

OBJECTS OF THE INVENTION

With the foregoing in mind, it is a primary object of the present invention to provide a novel merchandise display package capable of being hung from a rod or hook.

It is another object of the present invention to provide an improved hanger which cooperates with the walls of a container in a novel manner to provide a package which can be hung from a rod or hook.

As a still further object, the present invention provides a container and a unique hanger which can be assembled readily with the container.

A still further object of the present invention is to provide for a container a separate hanger which is positively mounted to the container so as to resist inadvertent disengagement from the container during handling.

Yet another object of the present invention is to provide a product package having a hanger which is relatively strong so as to enable significant bulk and weight to be carried in the package.

A further object of the present invention is to provide for a product package a hanger which is both strong and resistant to tearing.

SUMMARY OF THE INVENTION

As a more specific object, the present invention provides a package which is designed to be hung from a hook or rod. The package comprises a container having a rear wall, side walls, and a top wall with an aperture adjacent its intersection with the rear wall. A hanger is assembled with the container. The hanger has a head portion which projects upwardly above the top wall to provide an opening adapted to engage the hook or rod and a pair of arms extending outwardly for engaging the underside of the top wall. The head is dimensioned to pass upwardly through the aperture and is shaped to have a notch adjacent one of the arms for receiving a portion of the top wall of the container adjacent one end of the aperture. The hanger is fabricated of a flat, flexible material which enables the arm on the side of the head opposite the notch to be flexed forwardly to enable the head to be pushed upwardly through the aperture while latching the hanger in place when the arm is released and allowed to assume its relaxed, flat configuration with the end of the arm engaged against a sidewall of the container.

BRIEF DESCRIPTION OF THE DRAWINGS

The foregoing and other objects, features and advantages of the present invention should become apparent from the following description when taken in conjunction with the accompanying drawings, in which.

DESCRIPTION OF PREFERRED EMBODIMENT

Figure 1:
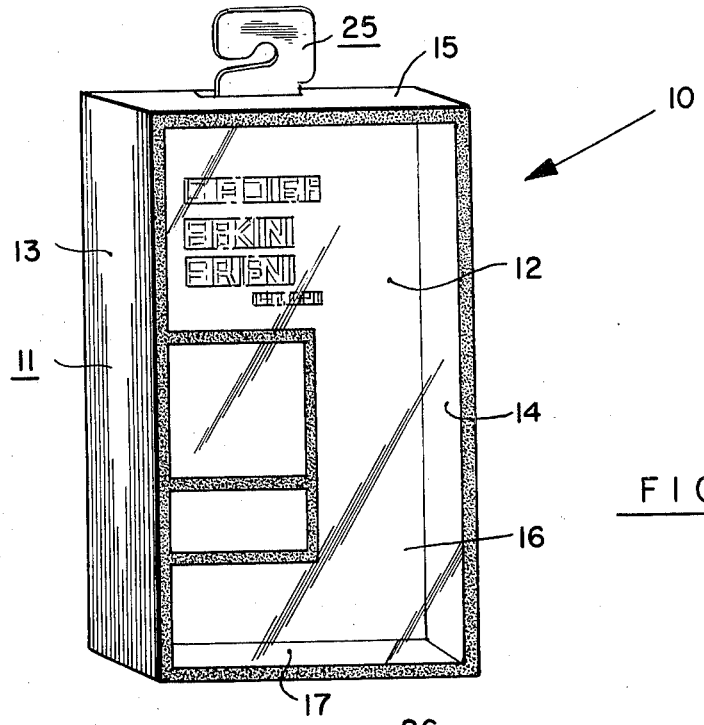
FIG. 1 is a perspective view of a product display package embodying the present invention.

Referring now to the drawings, FIG. 1 illustrates a product display package 10 which embodies the present invention. The package 10 comprises a container 11 having a pair of spaced vertically disposed sidewalls 13 and 14, a top wall 15, and bottom wall 17, which walls project forwardly from the rear wall 12 to form lines to juncture at their intersections, such as the line of juncture 15' (FIG. 3) between the rear wall 12 and the top wall 15. A front wall 16, preferably of clear plastic, has rearwardly-turned peripheral flanges which embrace the sidewalls, and the top and bottom walls of the container 11. The clear plastic front wall 16 may also include appropriate printed matter and, of course, enables the product within the package 10 to be viewed from the front.

As described thus far, the container 11 is conventional. According to the present invention, the container 11 is modified slightly to enable it to be hung from a support, such as a rod or hook, singly or in tandem with a series of like containers. To this end, the container 11 is provided with an elongated aperture 20 which extends adjacent the line of juncture 15' between the top wall 15 and the rear wall 12. Preferably, the aperture 20 is provided in the top wall 15 and has one end, such as the righthand end **20*a* (FIG. 2) located further from the righthand sidewall 14 than the lefthand end 20*b* is located from the lefthand sidewall 13. Both the length and width of the aperture 20 have predetermined dimensions, as will be discussed. The aperture 20 may be formed either during the formation of the container 11**, or subsequent thereto by a simple cutting or punching operation.

Figure 2:
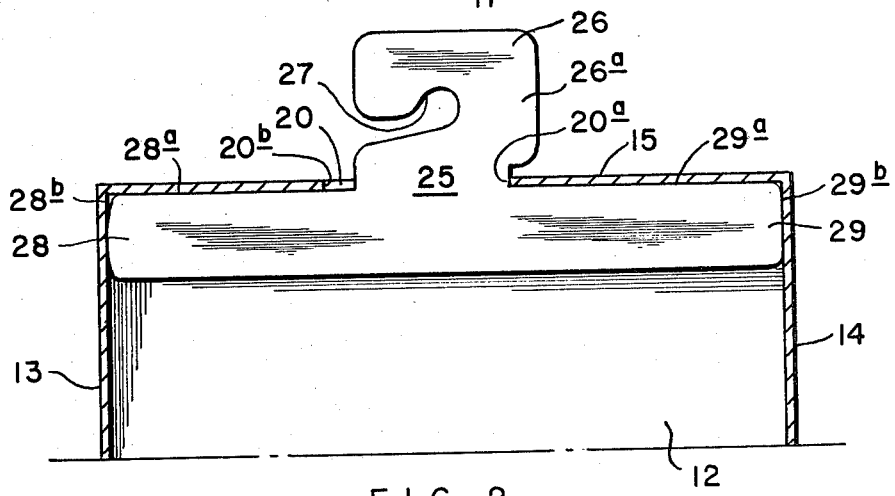
FIG. 2 is a fragmentary, enlarged sectional view of the upper portion of the package illustrated in FIG. 1, the view illustrating a hanger cooperating with top, side and rear walls of a container.

A hanger 25 is provided for cooperating with the container 11 to enable the package 10 to be hung from a rod or hook. As best seen in FIG. 2, the hanger 25 has a head portion 26 which projects upwardly beyond the top wall 15 of the container 11 and which has an opening 27 with a lateral slot enabling the head 26 to be engaged laterally on a rod or hook. While a lateral slot is illustrated, it should be apparent that a simple hole may be provided in the head 26, if desired.

In order to anchor the head 26 to the container 11, the hanger 25 has a pair of arms 28 and 29 which extend outwardly in opposite directions from the head 26. Preferably, the head 26, and arms 28 and 29, are fabricated of a relatively thin, flexible material, such as plastic, which enables the arms, and particularly arm 28, to be flexed relative to the head 26 and arm 29, such as in the manner illustrated in FIG. 3. Preferably, the hanger 25 has a normally flat, relaxed configuration when assembled in the container 11 in the manner illustrated in FIG. 2. When thus assembled, the upper edges 28*a* and 29*a* of the arms 28 and 29, respectively, engage the underside of the top wall 15, and opposite end edges 28*b* and 29*b* of the arms 28 and 29, respectively, engage the insides of the sidewalls 13 and 14, respectively. Because of the location of the aperture 20 adjacent the rear wall 12, the hanger 25 lays flat against the upper margin of the rear wall 12 when thus installed.

In order to afford rapid assembly of the hanger 25 with the container 11 and to prevent inadvertent disengagement of the hanger 25 during handling of the package 10, means is provided for latching the hanger 25 in place in the container 11. In the illustrated embodiment, the latching means is provided by a notch 30 defined between an enlargement 26*a* of the head 26 and the inner end of the upper edge 29*a* of the righthand arm 29. As illustrated in FIG. 2, the notch 30 receives the top wall 15 of the container adjacent the righthand end 20*a* of the aperture 20, and the enlargement 26*a* of the head 26 prevents the hanger 25 from sliding downwardly relative to the container 11 from the assembled position illustrated in FIG. 2. The dimension between the right end 20*a* of the aperture 20 and the righthand sidewall 14 corresponds substantially to the dimension of the righthand arm 29 measured from the depth of the notch 30 while the dimension between the left end 20*b* of the aperture 20*b* and the lefthand sidewall 13 is considerably less. This prevents the hanger 25 from being flipped over and an attempt made to install it improperly.

When assembled, the hanger 25 is normally urged rightward so that the top wall 15 is received by the notch 30 in the manner illustrated in FIG. 2. For this purpose, the length of the lefthand arm 28 is dimensioned so as to cause the notch to be engaged against the righthand end 20*a* of the aperture 20 when the end 28*b* of the arm 28 is engaged against the inside of the lefthand sidewall 13. In order to prevent the hanger 25 from cocking relative to the top wall 15, at least the arm end edge 28*b* and preferably both edges 28*b* and 29*b* of the arms 28 and 29, respectively, are disposed at right angles relative to the top edges 28*a* and 29*a* of the arms. The maximum widthwise dimension of the head 26 should be slightly less than the lengthwise dimension of the aperture 20 in order to enable the hanger 25 to be installed with a minimum of manipulation by a simple straight upward motion.

Figure 3:
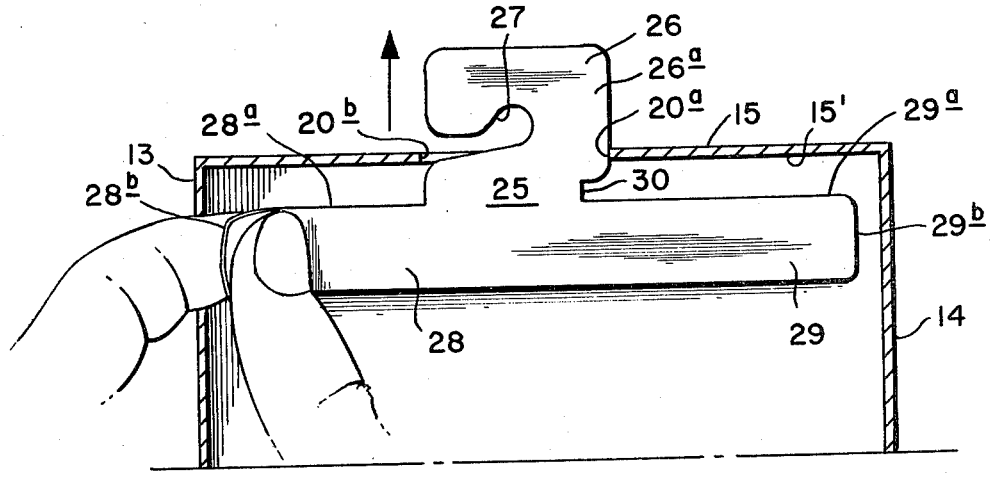
FIG. 3 is a view similar to FIG. 2 but illustrating the manner in which the hanger is assembled with the container prior to its assuming the locked position illustrated in FIG. 2.

In order to assemble the hanger 25 with the container 11, the right hand arm 29 and head 26 of the hanger 25 are laid flat against the upper portion of the rear wall 12, and the lefthand arm 28 is flexed forwardly in the manner illustrated in FIG. 3. The head 26 of the hanger 25 is then aligned with the aperture 20 and is pushed upwardly in the direction indicated by the arrow until the upper edges 28*a* and 29*a* of the arms 28 and 29 engage the underside of the top wall 15. Thereupon, the lefthand arm 28 is released and, as it returns to its normally-flat relaxed configuration, the lefthand edge 28*b* of the lefthand arm 28 engages the sidewall 13 and functions, preferably with a slight rightward push by the assembler, to displace the hanger 25 rightward for causing the top wall 15 to engage in the notch 30 in the manner illustrated in FIG. 2. When thus assembled, the hanger 25 is prevented from both moving either vertically downward relative to the top wall 15 or cocking relative thereto. By virtue of the interengagement between the arms 28 and 29 with the underside of the top wall 15, and the rigidity of the arms about an axis perpendicular to the plane of the rear wall 12, the container 11 is able to support goods of moderate weight.

Of course, the hanger 25 can be removed from the container 11 simply by reversing the above sequence of steps should such removal be desirable.

In view of the foregoing, it should be apparent that the present invention now provides an improved package 10 for enabling goods to be merchandised on hooks. The package 10 comprises a novel hanger which cooperates with a container which has been modified slightly to enable the hanger to be assembled readily with the container. Moreover, the hanger is prevented from being inadvertently disengaged from the container by its novel shape and cooperation with various walls of the container. Since the hanger is fabricated of plastic, it is strong and resistant to tearing, as contrasted with prior art cardboard packages having tabs which can tear readily.

While a preferred embodiment of the present invention has been described in detail, various modifications, alterations and changes may be made without departing from the spirit and scope of the present invention as defined in the appended claims.

I claim:

1. A package adapted to be supported by a hook, comprising: a container having at least first and second sidewalls and a top wall including an aperture, said aperture having first and second ends corresponding to said first and second sidewalls respectively; and a separate hanger assembled with said container, said hanger having a head with an opening projecting above said top wall for engagement by a hook, the maximum widthwise dimension of said head being substantially equal to or less than the lengthwise dimension of said aperture between said first and second ends of said aperture, first and second arms extending away from said head in said first and second directions respectively and engaging the underside of said top wall, said first and second directions corresponding to said first and second sidewalls, the length of said first arm being greater than the distance between said first end of said aperture and said first sidewall, a notch formed between said head and said second arm adapted to receive a portion of said top wall at said second end of said aperture, said first arm being flexible about a vertical axis and having an outer edge adapted to engage said first sidewall to provide means for urging said entire hanger in said second direction for latching said notch in engagement with said top wall, whereby downward movement of said hanger relative to said container is prevented.

2. A package according to claim 1 wherein said hanger is fabricated of a relatively thin, flexible member having a substantially flat relaxed configuration.

3. A package according to claim 1 wherein said container further comprises a rear wall and wherein said aperture is located in said top wall close to said rear wall so that when assembled said hanger arms engage both the rear wall and underside of the top wall.

4. A package according to claim 1 wherein said second arm abuts said second sidewall.

5. A package according to claim 4 wherein the outer edges of said arms are at right angles to the upper edges of said arms.

6. A package adapted to be supported by a hook, comprising: a container having at least a rear wall, first and second sidewalls and a top wall including an aperture, said aperture having first and second ends corresponding to said first and second sidewalls respectively; and a separate hanger assembled with said container, said hanger having a hook-engageable head projecting above said top wall, the maximum widthwise dimension of said head being substantially equal to or less than the lengthwise dimension of said aperture between said first and second ends of said aperture, first and second arms extending away from said head in first and second directions respectively and engaging the underside of said top wall, said first and second directions corresponding to said first and second sidewalls respectively, a notch formed between said head and said second arm adapted to receive a portion of said top wall at said second end of said aperture, and means for urging said entire hanger to be displaced in said second direction for latching said notch in engagement with said top wall.

7. A package according to claim 6 wherein said aperture is located in said top wall close to said rear wall so that when assembled said hanger arms engage both the rear wall and underside of the top wall.

* * * * *